United States Patent [19]

Hebert

[11] 3,994,381

[45] Nov. 30, 1976

[54] WIRE MATRIX PRINT HEAD

[75] Inventor: Donald G. Hebert, San Ramon, Calif.

[73] Assignee: The Singer Company, Elizabeth, N.J.

[22] Filed: Apr. 23, 1975

[21] Appl. No.: 570,683

Related U.S. Application Data

[63] Continuation of Ser. No. 354,574, April 26, 1973, abandoned.

[52] U.S. Cl. ..... 197/1 R; 101/93.05

[51] Int. Cl.[2] ..... B41J 3/10

[58] Field of Search ..... 197/1 R; 101/93.05, 101/109

[56] References Cited

UNITED STATES PATENTS

| | | | |
|---|---|---|---|
| 3,266,419 | 8/1966 | Erpel et al. | 101/93.05 |
| 3,504,623 | 4/1970 | Staller | 101/109 X |
| 3,690,431 | 9/1972 | Howard | 197/1 R |
| 3,770,092 | 11/1973 | Grim | 197/1 R |
| 3,828,908 | 8/1974 | Schneider | 197/1 R |
| 3,833,105 | 9/1974 | Howard | 197/1 R |
| 3,842,955 | 10/1974 | Iwasaki | 197/1 R |
| 3,848,719 | 11/1974 | Milan | 197/1 R |
| 3,854,564 | 12/1974 | Flaceliere | 197/1 R |

FOREIGN PATENTS OR APPLICATIONS

| | | | |
|---|---|---|---|
| 1,577,409 | 6/1969 | France | 197/1 R |
| 2,119,641 | 11/1972 | Germany | 197/1 R |

*Primary Examiner*—E. H. Eickholt

*Attorney, Agent, or Firm*—Edward L. Bell; Robert E. Smith; Julian Falk

[57] ABSTRACT

A wire matrix print head comprised of a plurality of impact print wires or styli, each having an input end for receiving an impact and an output end for delivering an impact to a record medium through an inking ribbon. The impact end of said wires or styli are arranged in a specialized elliptical format while the output end of the wire styli are formed into a planar straight line configuration, thus providing for a minimal amount of bending arc along the length of the styli. This configuration permits direct transmission of the impact forces to the output end and permits each stylus to be of equal length to the other styli. Efficacious provision is made for adjusting the stroke length of each stylus even though a uniform electromagnet for each stylus is used to provide the activating or impact impulse.

4 Claims, 7 Drawing Figures

WIRE MATRIX PRINT HEAD

This is a continuation of U.S. application Ser. No. 354,574, filed Apr. 26, 1973, now abandoned.

BACKGROUND OF THE INVENTION

FIELD OF THE INVENTION

This invention relates to a high-speed printer of the matrix type wherein a plurality of thin wire styli are selectively impacted in order to deliver an impact to a record medium.

In the present day use of high-speed output devices, such as result from electronic calculators, computing machines, and data processing equipment, it is necessary to print output information very rapidly clearly, efficiently, and often with the capability of producing multiple instantaneous copies.

In such a printer with mechanical elements, the inertia of the mechanical elements is a factor which may limit the speed of operation. In such high-speed use of matrix printers having a plurality of styli wires to form dots which can be printed so as to form character configurations, the low masses of the wire styli and the actuating mechanisms permit the accomplishment of very high-speed operation, especially since each wire stylus need only travel a very short stroke to make its impression on the record medium.

The printer of the present invention is that type which has the styli wires so arranged at its output end so as to form a straight line which can be moved across a record medium rapidly to print and form characters on the record medium. Each character printed would be formed by a sequence of successive wire impacts on the moving medium.

In the prior art, a variety of wire dot matrix printers have been developed having various types of elements and configurations. Some of these printers have a single drive or actuating means which is used to selectively actuate one or more of the wire styli. Other forms of such matrix printers have a plurality of actuating means for activation of various of the wire styli. Among the problems involved therein is the physical space problem wherein the actuating means for each of the various styli require that the styli be widely spaced at the end wherein the styli receive their actuation and at the same time, at the other end, the styli tips (which deliver the impact to the record medium) must be brought into a very small aligned spacial configuration. This has generally required, in the prior art, that each of the styli must be rather sharply bent from a wide separation at one end to a close alignment at the other end with the result that certain styli must be of longer length than others and other styli must be of shorter length than others. The various lengths and various difference in masses involved in the styli and the various amount of arcing or bending along the length of the styli present problems which must be overcome by complex guide means and complex driving or actuation means wherein each stylus must be compensated for the amount of energy impact it receives, the length of the stroke of the activating means which hammers it and the mass and acceleration of the hammer which delivers the impact to the stylus.

Among other problems that arise in the use of the wire styli for printing at high speeds, is the factor of rapid return to "home" position of each stylus without excessive bouncing, vibration, or overshoot. This generally has been accomplished in the prior art by means of spring bias means.

Other factors and problems involved in the prior art in regard to such wire stylus dot printers involve the delivering of sufficient acceleration and velocity to each individual wire stylus in order to result in sufficient impact at the printing end of the stylus to print rapidly and clearly on one or on several underlying recording media, and with sufficient rapidity of return to home position to enable quick availability for the next impact cycle. Thus, the diminution of mass both of the wire stylus and of the actuating or impact means has been a problem of considerable importance in addition to developing rapid yet simple means for selectively actuating each of any of the individual styli both separately and/or simultaneously.

SUMMARY OF THE INVENTION

In accordance with the subject invention, there is obtained a high-speed matrix dot printer by utilizing a plurality of wire styli which are grouped at one end (output end) as a straight line in a plane and at the opposite end are formed along the periphery of an elliptical plane. Each individual stylus is spring biased to its "home" position and is fixedly attached to a nylon impact button which is subject to an impact from an armature of an electromagnet. A plurality of uniformly constructed electromagnets are provided, each of which has an armature having a hammer or impact end such that one electromagnet and armature-hammer is provided for each wire stylus. Each of the uniform electromagnets has an armature which is held by a specialized armature retainer, which armature retainer provides for simple adjustment of the position and stroke length of the structure. The armature retainer also provides spring bias means for positioning the armature in its nonenergized position.

Due to the specialized elliptical positioning of the impact receiving ends of the wire styli, the elongated length of each of the styli are of equal length to each other and have only a minimal amount of arc or bend along the elongation of the wire stylus, this bending being equal to or less than one wire diameter (0.014 inch). This permits direct transmission of impact from one end of the stylus to the other, and further there is no need for making separate and different adjustments in the strokes of the various armatures to compensate for differences in length, mass, or angle of bend of the various wire styli.

The printer of the subject invention is capable of greater than 1,000 imprints per second per individual stylus.

Further, due to the simplicity of the wire styli in 30 that they are of equal length, equal mass, and minimally bent, and since there are no variations in impact energy or stroke differences involved between the various styli, each of the activating electromagnets and armature assemblies can be made uniform in nature so that considerable economy in parts, assembly, and maintenance are provided both in terms of simplicity and cost.

Further, an armature retainer is provided with an elastomeric bumper cushion adjacent and opposite the impact side of the armature which thus acts as a bumper-cushion to dampen any excessive vibration resulting from the de-energization of the electromagnets and from the return cycle of the armature and of the spring biased wire stylus after its impact-print cycle is completed.

DESCRIPTION OF THE PREFERRED EMBODIMENT

Figure 1:
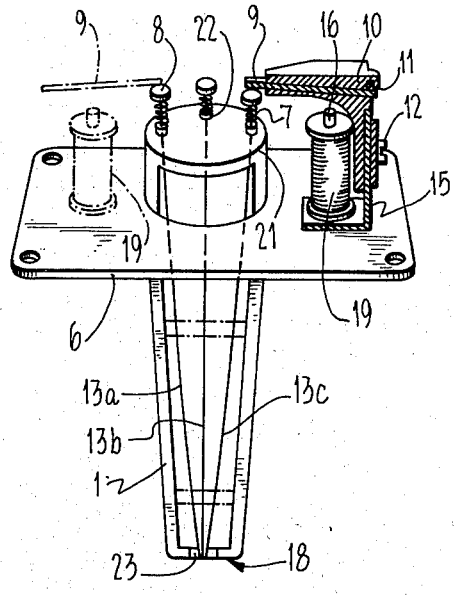
FIG. 1 is an isometric and schematic representation of the wire matrix print head showing the major components in cooperative relationship.

In FIG. 1 there is seen a side or elevation view of a simplified schematic drawing of the wire matrix print head. Only the essential elements are shown for clarity while the manifold and other elements are shown in other drawings.

A metal mounting plate 6 is shown supporting a stylus wire guide assembly 1 and also a series of electromagnetic armatures 9 in a general configuration which surround the central portion of the wire guide assembly 1, especially the area designated 21 which is the upper portion of the wire guide assembly and which may be designated as a circular cylindrical block through which the stylus wires (such as 13*a*, 13*b*, 13*c*, etc.) pass and which terminate in a head or impact button 8 located proximately to an armature 9.

Figure 4A:
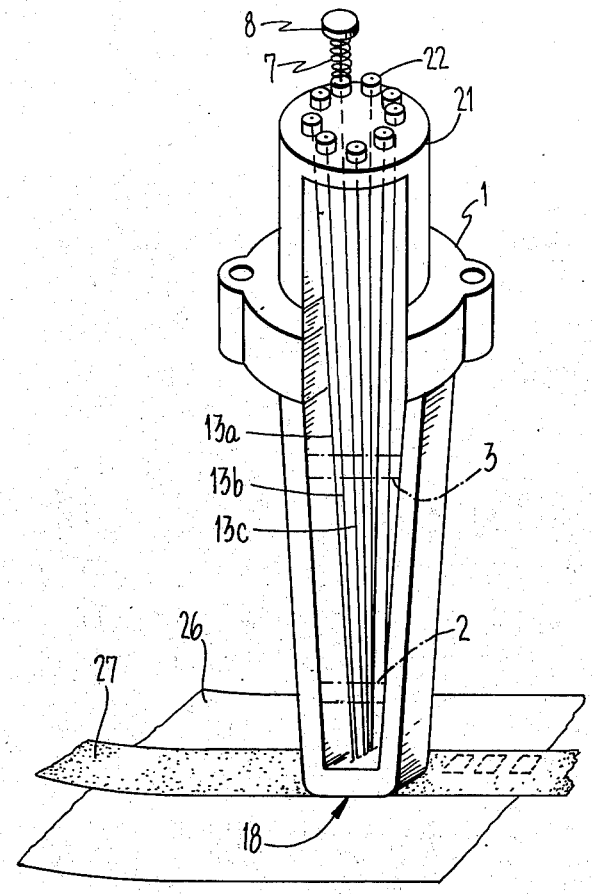
FIG. 4A is a perspective schematic view of the wire guide assembly showing the wire styli being supported at the output end for printing on paper through ribbon while the input end of each stylus is brought through a circular cylindrical portion having apertured extensions on the planar surface of the cylindrical head and on which the locus of the pin hole supports are formed in an ellipse.

It will be seen that relative downward motion of the magnetic armature 9 will operate so as to strike the impact head or button 8 in order to drive into motion a wire stylus such as 13, which at the "output end" 18, will extend beyond the base of the wire quide assembly in order to press against a ribbon and paper in order to imprint a dot mark (see FIG. 4A). After the finish of the hammer impact of armature 9 against the impact button 8, then the compression or return spring 7 will cause the stylus to return upward into its normal or home position.

Figure 3:
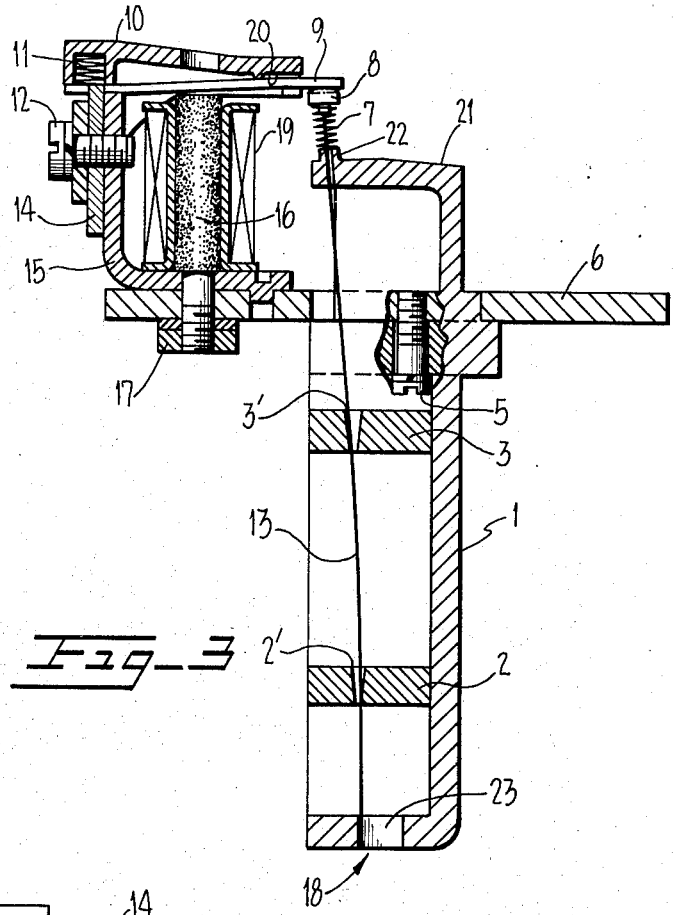
FIG. 3 shows a side view of a cutout (3—3 of FIG. 2) of the wire matrix print head illustrating how the armature contacts the impact head to drive the stylus wire which is supported by the wire guide assembly.

Referring to FIG. 1 and FIG. 3, the armature 9 is held in an electromagnet assembly in which a magnetic core 16 which defines a center pole of the electromagnet and which is surrounded by a coil 19 in a general configuration about the cylindrical block extension 21. A nut 17 holds the magnetic core 16 to the mounting plate 6 in addition to securing the magnetic yoke 15 which bends from the base up around the side of the magnetic core 16 and defines an outer pole of the electromagnet.

Adjustably attached to the magnetic yoke 15 is an armature retainer 10 having a central portion overlying the stylus engaging end of the armature and an arm extending radially outward from the central portion beyond the outer pole for applying a moment of force to the armature tending to cause the stylus engaging end to rotate about the outer pole toward the central position which holds or retains the magnetic armature 9 in close proximity to the top of the magnetic core 16.

A loading spring 11 ensures that the outer end of the armature 9 will be maintained in close proximity to the top of yoke 15 in order to maintain a continuous circuit for magnetic flux. At the inside or hammer end of the armature retainer 10, there is provided a backstop or bumper cushion 20 which cushions the return shock of the armature back against the retainer 10.

The actual stroke or motion distance accomplished by the armature 9 in its hammer-like action against the stylus impact button head 8 is determined by adjusting the height of the armature retainer 10 by means of screw 12 and a mounting clamp 14.

Figure 2:
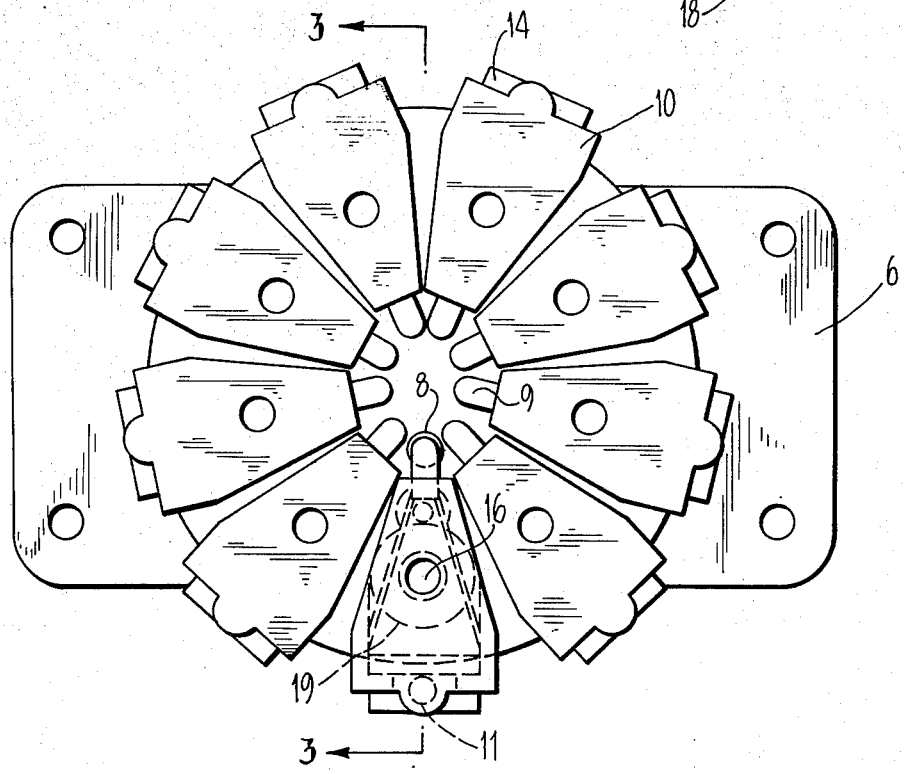
FIG. 2 is a plan view (looking from the top) of the wire matrix print head showing an arrangement of nine electromagnetic armatures used as hammers to drive the wire styli (which print against a ribbon on paper at the output end).

In FIG. 2, there is shown a plan or top view of a wire matrix print head showing a series of 9 magnetic armatures (hammers) placed in a configuration about the circular cylindrical block 21. Each armature 9 covers the impact button head 8 of the individual wire styli which may be actuated into motion underneath the armature tip 9.

The entire assembly of the nine electromagnets and armatures is supported on the mounting plate 6 and one particular electromagnet is shown in greater detail in order to illustrate what lies underneath. As will be seen by the broken lines, there rests a core 16 underneath each of the armature retainers 10. At the extreme end of each armature retainer, there is found a small housing which carries the armature loading spring 11 (as shown by the dotted line) and a coil 19 is placed around the core 16.

Referring to FIG. 3, a side cutout view of the matrix print head is shown.

The wire guide assembly 1 is shown having an input end 21 (which constitutes the cylindrical circular block at the input end) and a planar output end 18 having a scalloped ruby 23 through which pass the stylus wires 13. The stylus wires 13 are flexibly supported by a cross brace with an aperture and designated as the lower wire support 2. Likewise, an upper wire support 3 is also provided.

At the extreme top end of the wire guide assembly 1, there will be found a series of apertured extensions, designated as 22, which receive the stylus wire, such as 13, and act as a guide and support factor.

The stylus wire 13 has at its extreme top a nylon plastic impact button which receives the impact from armature 9 and which is rigidly and fixably attached to the stylus to carry the motion of the armature to the wire stylus. Between the impact button 8 and the apertured extension 22, there resides a wire return spring 7. This is a compression spring which acts to cause the wire stylus 13 to return to its normal home or rest position after activation by the hammering impact of the armature 9.

Also seen in FIG. 3 is the mounting means by which the wire guide assembly 1 is mounted to the mounting plate 6. This is accomplished by mounting screw 5 which connects the wire quide assembly to the mounting plate.

In FIG. 3, on the left side of the mounting plate 6, there is seen the electromagnet assembly consisting of magnetic core 16, a magnetic yoke 15, a mounting nut 17 for holding the core to the mounting plate 6, an electric coil 19 placed around the core 16, and an armature 9 which is held in place and retained by armature retainer 10. The armature retainer 10 is adjustably attached to the yoke 15 by means of screw 12 and mounting clamp 14. At the outward portion of the armature retainer 10, there is seen a loading spring 11 which serves as an armature loading spring to maintain the armature in a set position when the magnetic coil is de-energized.

Figure 4B:
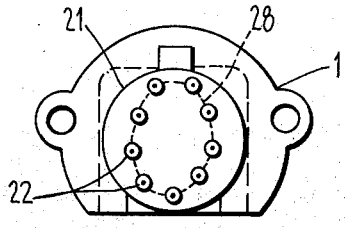
FIG. 4B shows a plan or top view of the cylindrical block of the wire guide assembly, including the raised stylus holes used to support the stylus wires which are arranged in elliptical configuration.
Figure 4C:
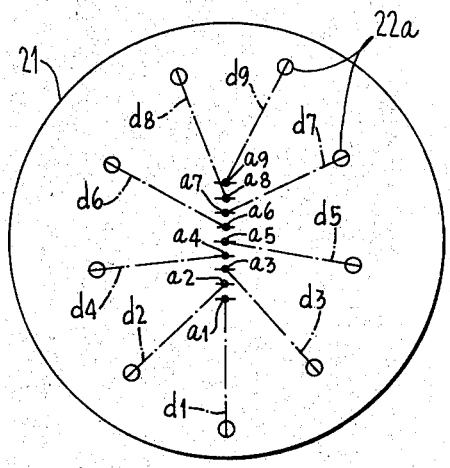
FIG. 4C shows an enlarged view of the circular plane of the top cylindrical extension of the wire guide assembly, from a plan or top view, and illustrates in schematic form how the pin hole supports for the wire styli are located to form a locus of points equally spaced along the periphery of an ellipse.

FIGS. 4A, 4B, and 4C show in greater detail the advantageous configuration of the styli (at the impact receiving or input end) and the efficacious means by which the wire styli are conveyed to the output end in the form of a straight line configuration.

FIG. 4A shows the wire guide assembly 1 having an output end 18 wherein the wire styli are brought into an aligned configuration by being mounted through the center of a bearing means. The outer end of the wire guide assembly 1 is shown at 21 as the circular cylindrical block having a configuration of apertured extensions 22. A typical apertured extension 22 is shown guiding a wire stylus 13*c*, up to an impact button 8. Between apertured extension 22 and the impact button 8 is a compression or return spring 7 as previously described.

FIG. 4B shows a top view of the circular cylindrical head 21 and the raised apertures 22. It will be seen that while the cylindrical block 21 has a circular plane surface, the actual position of the apertured extensions 22 are placed such that the locus of centers of the holes of the apertured extensions are resident along the path of an ellipse 28.

FIG. 4C shows in enlarged detail the format by which the apertured extensions 22 on the face of the cylindrical block 21 are placed in order to provide a locus of apertured centers 22*a*. It is seen that locations $_1$ through $a_9$ are spotted on the major axis of the ellipse. These locations $a_1$–$a_9$ determine the position at the output end tips 18 of the nine-wire styli as they are held in the bearing means 23 (FIG. 3).

The enlarged views of FIG. 4B and FIG. 4C show the placement of the hole centers 22a of the apertured extensions as lying on the periphery of an ellipse. The centers of stylus tips which are marked $a_1$ through $a_1$ represent the output end tips of the wire styli at the output plane 18. Taking a top view of the mechanism as looking down above over the FIG. 4A, then by observing FIG. 4C, the aperture points $a_1$ through $a_9$ represent the straight line which is the locus of centers of the nine-wire styli. The center holes of the apertured extension 22 are shown in FIG. 4C as 22*a*. The distance between any two adjacent apertures 22*a* of the apertured extensions 22 will be found to be equal as one travels around the periphery of the ellipse which is the locus of hole centers of the apertured extension 22. Likewise, the distance from any given stylus tip such as $a_1$ or $a_2$ over to the top plane of its aperture extensions 22 will also be found to be the same for each distance $d_1$, $d_2$, $d_3$, etc. Thus, the distance $d_1$ is the same as $d_2$, is the same as $d_3$, etc., is the same as $d_9$. It is in this manner that the overall length of the wire styli may be easily and efficiently made and fabricated to the exact same length.

The apparatus of the instant invention is constructed so as to be of rugged, durable, long-wearing construction while, at the same time, being of minimal size and mass in order to facilitate the movement not only of the wire styli and the armature hammers, but also the entire assembly into an easily accelerated condition from any static condition.

Thus, typically illustrative of an embodiment of the present invention is the feature where the wire styli such as $13_a$, $13_b$, $13_c$, etc. are composed of wire having a circular diameter of 0.014 of an inch and having an elongated length of 2.52 inches from the output end tip to the input end tip.

The armature 9 is preferably made of magnetic material such as nickel-plated steel, for example, having a thickness of 0.035 to 0.036 of an inch, said armature being held in place or mounted within a plastic armature retainer 10. The magnet core 16 is typically only approximately 1/ 10th of an inch in diameter and made of 2½% silicon iron. The major usable length of the magnet core is approximately 0.65 inch.

The wire guide and holder assembly 1 is made of strong but light plastic material, such as Delrin AF. In addition to the apertured extension 22 which positions the wire stylus at the impact receiving end, there are also two wire guide supports, an upper wire guide support 3, and a lower wire guide support 2 (FIG. 3). A tapered hole 3′ and a tapered hole 2′ are respectively placed in the upper and lower wire guide supports for maintaining the stylus in practically a straight line from the impact button 8 to the end or tip of the stylus at the output end 18.

The same features are true for each of the other eight styli, that is to say, that the upper wire guide support 3 and the lower wire guide support 2 are provided with suitable tapered apertures or openings which guide each individual wire stylus in a straight line to the termination point at the output end 18.

At the output end 18, there is inserted a bearing 23 which receives and aligns the plurality of wire styli into a straight line such that the tip of the wire styli will lie in a flat plane. This is of course only true when the styli are in their rest position, as they will extend upon activation according to the stroke adjustment of the armature hammer which may drive them.

The yoke 15 of the electromagnet may be made of steel plus 1% silicon iron and may have a thickness of 0.059 inch or approximately 16 gauge. The mounting plate 6 for the print head may be made of aluminum material approximately 1/10th inch thick.

The coil 19 which is placed around the core 16, after having been mounted on a nylon bobbin, may be composed of 200 turns of No. 28 wire and having a resistance of 0.95 ohms at room temperature.

Because of the simplicity of parts and assemblies of the subject mechanism, it is an easy task to replace the armature 9 which is normally of 20 gauge nickel-plated steel and increase its mass by, for example, making it of 10 gauge nickel-plated steel.

OPERATION

As can be seen from FIGS. 1 and 2, upon energization of any selected electromagnet or group of electromagnets, the respective armatures are energized so that they act as a hammer or deliver a sudden impact or impulse to the impact button or impact head of the respective wire styli.

At the output end of the print head, that is to say, the end from which the wire stylus projects in order to deliver an impact to an inking ribbon and record medium (such as paper) there are different situations which occur and which can be provided for as to the amount of travel or extension that is made by the wire styli. To a great extent, the amount of flight distance made by the wire styli would be adjusted in dependency upon the thickness of the inking ribbon and the thickness and type of the, for example, paper recording medium.

Very often in these applications, it is both desirable that a multiple series of forms be placed below the inking ribbon in order that many copies may be printed at once. In such a case, the stroke and "flight length" will be much less for a recording medium which has a rather large thickness as, for example, a six-part printed form with carbon paper interleaved between the forms.

On the other hand, if there is merely the printing of a single form or a single sheet through a nylon inking ribbon, then it is necessary that the length of the stroke or the "flight length" be considerably longer in order to reach and print upon the single sheet or single form upon which the information or characters are to be printed.

Figure 5:
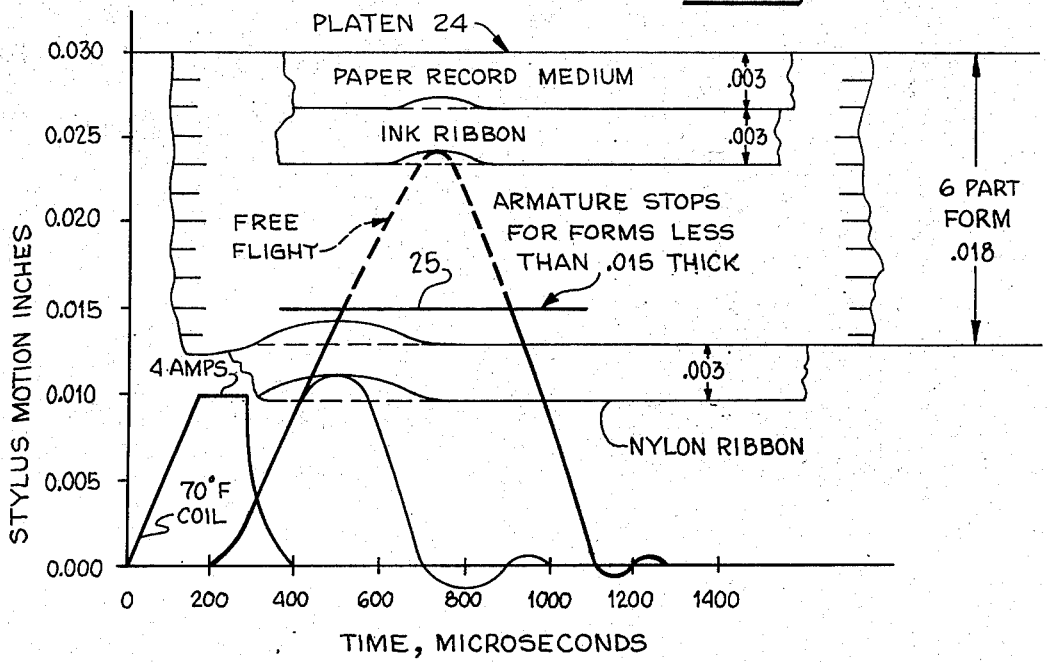
FIG. 5 is a graph of wire stylus motion against time (in microseconds) to illustrate wire flight and impact cycles for different thicknesses of record medium.

Reference to FIG. 5 will illustrate the cycle time differences for imprinting a single sheet or multiple copies which are supported by a platen 24 which is 0.030 inch from the output plane 18.

As an example of the present configuration and taking the situation wherein a single sheet or one part form is used which has, say approximately, a thickness of 0.003 inch, and where under this situation the single sheet of paper or recording medium is supported by a platen 24 which is 0.030 inch in distance from the output plane 18 of the matrix print head, then, under these conditions, the flight length of the output edge or tip of the wire styli is of the order of 0.025 inch, since the width of the recording medium which is 0.003 inch and the width of the nylon ribbon which is 0.003 inch shortens the distance between the output plane 18 of the print head and the ribbon line above the platen. Thus, the flight length or wire motion of 0.025 inch will ensure that there is a penetration of the nylon ribbon by at least 0.001 inch which is sufficient to properly cause an imprintation on the paper record medium.

In the apparatus of the present invention, when current is applied to a selected electromagnet or selected group of electromagnets in order to activate the respective styli, there may be a period of approximately 200 microseconds for the current to rise from zero to the required 4 amperes. This energization of the electromagnetic coil activates the magnetic armature into motion in order that it may act as a hammer and deliver a sudden impact to the impact button or impact head of the respective wire styli. From initiation of impact by the armature hammer against the impact heads, there is an acceleration provided to the wire stylus causing it to fly toward the nylon ribbon and record medium. The armature hammer may remain in contact with the impact head in a driving motion for approximately 200 to 250 microseconds as shown at line 25, after which the wire stylus continues to fly alone toward the nylon ribbon and record medium for approximately 300 microseconds at which time the impact of the nylon ribbon occurs.

Then, under the influence of the bias spring 7, the wire stylus is impelled back toward its home position and may take approximately 400 microseconds to return to home position. Before the wire stylus comes to rest, there may be a slight overshoot and return to rest which occurs within a period of 100 microseconds.

Thus, from the initial moment of impact and acceleration of motion of the wire stylus from its home position to impact with the nylon ribbon and then return to the home position in a rest position, there will have taken approximately 1,000 microseconds.

Thus, due to the situation of using a platen separated by 0.030 from the plane of the output end of the print head, and using a single sheet paper of say, approximately, 0.003 inch and a nylon inking ribbon of 0.003 it will be seen that it is possible to achieve a speed of dot printing of 1,000 imprintations per second, that is to say, as the head is moved across the paper record medium, it may print 1,000 dot combinations across the record medium per second as the head moves across the record medium (or as the paper is moved past the print head).

Now looking at the situation where the printer head is used to print upon mulitple copies such as, for example, a six-part form having a total thickness of 0.018 inch, if the distance from the output plane 18 of the print head to the underlying platen is again a total of 0.030 inch and the six-part form consumes 0.018 inch and a nylon ribbon fills up 0.003 inch, we then see that there is left remaining a distance of 0.030 less 0.021 or equal to 0.009 inch spacing or distance between the nylon ribbon and the output plane of the print head.

In this situation, again assuming a 200 microsecond period to achieve complete energization of the electromagnet, the flight length will be only approximately 0.009 inch plus 0.001 inch penetration into the nylon ribbon for a total of 0.010 inch flight length, that is to say, flight length from rest position to impact against the nylon ribbon for imprintation upon the record medium.

In this particular case, due to the shorter flight length, the accelerating wire stylus (having only 0.010 inch flight length) will achieve its impact within 200 to 250 microseconds after which, the spring biasing means will cause the wire stylus to return to home position within 200 microseconds, and then will require approximately another 200 microseconds to stabilize at rest in the home position. Thus, in this case, using the multiple copy forms and a shorter flight length, the entire initiation, impact and return-to-rest cycle has taken only 800 microseconds. Thus, in this case with the multiple copy forms and shorter flight time, the actual printing speed is even higher than in the previous case. Thus, in the case at hand, it would be possible to imprint 1,250 dot imprintations per second either by motion of the print head across the paper or motion of the paper across the print head.

Assuming a character imprintation system wherein characters are printed out by means of the matrix print head, and each character is composed of a block or matrix which may be 9 dots high and 4 dots wide, and further assuming the space between any two given letter characters as being one "blank", it would then take 5 dot sequences to constitute one character space (including the character imprintation and its space to the next character).

Taking this figure of 5 and dividing this into the figure of 1,250, then 250 characters per second could be printed by the machine which uses the presently developed wire matrix print head.

Reliability tests on the print head of the present invention have already indicated more than 200,000,000 successive operations without failure or inadequacy or operation. This is quite remarkable considering that the cost and simplicity factor has been reduced by at least a factor of 5 to 10 over previously known print heads.

Having thus described and illustrated the elements of this wire matrix printer, the following claims are made.

I claim as my invention:

1. A wire matrix impact print head comprising a mounting plate;

stylus guide means affixed to said plate;

a plurality of electromagnetic structures mounted to said plate and disposed around said guide means, each of said electromagnetic structures having an outer pole, a center pole coupled to said outer pole, and a coil disposed around one of said poles;

a plurality of armatures disposed radially about said guide means, each of said armatures being associated with one of said electromagnetic structures to form an electromechanical actuator for transferring electromechanical energy to a stylus, and each of said armatures having a stylus engaging end and an outer end that extends in cantilevered fashion outside of said outer pole;

a plurality of styli carried by said guide means, each of said styli being of an elongated rod-like configuration having a free head end for engagement by the stylus engaging end of one of said armatures and a printing end for impacting a recording medium when the stylus is propelled through said guide means by one of said actuators;

each stylus of said plurality of styli has a length and mass equal to the length and mass of each of the other styli being held by said guide means for substantially straight line movement;

said guide means is so formed as to position the locus of the free head ends of the styli on the periphery of an ellipse;

a plurality of retaining means each having a central portion connected to said guide means; and an arm engaging the outer end of one of said armatures for applying a moment of force thereto tending to cause the stylus engaging end to rotate about said outer pole toward said central portion.

2. A wire matrix impact print head comprising:

a mounting plate having a central aperture;

a guide connected to said mounting plate and extending through said central aperture, the top end of said guide having a plurality of guide apertures arranged in an elliptical array, and the bottom end of said guide having a plurality of guide apertures arranged in a straight line array;

a plurality of springs;

a plurality of styli, each having an enlarged head at one free end and passing through one of said springs, through one of said guide apertures in said top end of said guide and through one of said guide apertures in said bottom end of said guide, said springs serving to resiliently bias said styli into a rest position;

a plurality of electromagnetic structures connected to said mounting plate, each of said structures having an outer pole, a center pole coupled to said outer pole, and a coil mounted around one of said poles;

a plurality of elongated armatures each having a stylus engaging end and an outer end, and each being associated with one of said electromagnetic structures and pivotable about the outer pole thereof; the respective combinations of armature and electromagnetic structure forming a plurality of electromagnetic actuators for selectively propelling various ones of said styli through said guide apertures; and a plurality of retainers coupled to said mounting plate and each including a central portion having a shock absorbing means and an arm radiating from said central portion, each of said arms (1) engaging one of said outer ends to hold the associated armature in contact with one of said outer poles to form an electromagnetic actuator, (2) holding the associated armature in alignment with one of said heads of one of said styli, and (3) providing a moment of force to the associated armature tending to cause the armature to rotate about the associated outer pole and into engagement with said shock absorbing means, said retainer further including an adjustment means for enabling the air gaps between the armatures and the center poles of each of said electromagnetic actuators to be adjusted.

3. A wire matrix printing head comprising a plurality of wire styli each of which has a free input end and a free output end, bearing means forced with a planar recording medium accomodating surface and bearing apertures for constraining said styli output ends each substantially perpendicular to said planar recording medium accomodating surface, each of said wire styli being of equal length and mass, guide means for constraining the input ends of such styli relatively to the output ends thereof such that the projection of each equal length styli on the planar recording medium accomodating surface is a line of equal length, and a plurality of electromagnetic activation means carried by said guide means and associated one with each one of said wire styli, each of said electromagnetic activation means including an armature separate from said associated stylus, pivotal support means for said armature, an electromagnetized core for driving said armature about said pivotal support means, and means for constraining each armature substantially perpendicular to said associated stylus and with a portion of said armature arranged for driving engagement with the free input end thereof, the armatures and electromagnetized cores for each of said electromagnetic activation devices being identical to each other and arranged each with equal distances between said pivotal support means and said electromagnetized cores and between said pivotal support means and the portion arranged for driving engagement with said associated stylus input end.

4. A wire matrix printing head as set forth in claim 3 wherein each of said armature portions arranged for driving engagement with the associated stylus is tapered in width a substantially equal amount and wherein said armature portions which are arranged for driving engagement with the associated styli are disposed relatively to each other in evenly spaced relation with minimum uniform spacing therebetween only sufficient for accomodation of independent armature activation without interference thus to provide for the shortest equal projected length of each of said styli on the planar recording medium accomodating surface.

* * * * *